US006722924B1

(12) United States Patent
Zhou et al.

(10) Patent No.: US 6,722,924 B1
(45) Date of Patent: Apr. 20, 2004

(54) CABLE CONNECTOR ASSEMBLY

(75) Inventors: Hong Bin Zhou, Kunsan (CN); Zhigang Cai, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/330,990

(22) Filed: Dec. 24, 2002

(30) Foreign Application Priority Data

Dec. 10, 2002 (TW) ..... 91220007

(51) Int. Cl.[7] ..... H01R 13/648
(52) U.S. Cl. ..... 439/608
(58) Field of Search ..... 439/95, 607, 609, 439/610, 608, 701

(56) References Cited

U.S. PATENT DOCUMENTS 5,611,711 A * 3/1997 Okada et al. ..... 439/608
5,685,739 A 11/1997 Davis et al.
5,865,651 A * 2/1999 Dague et al. ..... 439/680
6,056,578 A * 5/2000 Lin ..... 439/358
6,074,218 A * 6/2000 Wu et al. ..... 439/63
6,193,554 B1 2/2001 Wu
6,210,216 B1 * 4/2001 Tso-Chin et al. ..... 439/545
6,234,834 B1 5/2001 Tsai et al.
6,439,926 B1 * 8/2002 Kuan ..... 439/607

* cited by examiner

*Primary Examiner*—Javaid H. Nasri
*Assistant Examiner*—Thanh-Tam Le
(74) *Attorney, Agent, or Firm*—Wei Te Chung

(57) ABSTRACT

A cable connector assembly (1) includes a housing (10), a pair of first electrical connectors (20), a pair of second electrical connectors (30), a shielding member (40), a pair of first cables (50) and a second cable (50). The housing has an elongate base (103). The base has a mating face (105) and a rear face (106) opposite to the mating face. The base defines a pair of first cavities (101) and a pair of second cavities (102) arranged side by side and extending inwardly from the mating face. The first cables and the second cable respectively electrically and mechanically connects with the first electrical connectors and the second electrical connectors and extend beyond the rear face for being mounted on a mother board of an electronic apparatus. The shielding member is assembled on the housing. The cable connector assembly can be fastened on a panel of the electronic apparatus for providing input/output ports.

2 Claims, 4 Drawing Sheets

CABLE CONNECTOR ASSEMBLY

CROSS-REFERENCE TO RELATED APPLICATION

This patent application is a co-pending application of U.S. Patent Application contemporaneously filed with the present invention, with Ser. No. 10/330,989 entitled "CABLE CONNECTOR ASSEMBLY HAVING IMPROVED GROUNDING MEANS", invented by Chin Shen Wu and Zhou hong bin, and to the same assignee as the present application.

BACKGROUND OF THE INVENTION

1. Field of the Invention

The present invention generally relates to a cable connector assembly, and particularly to a cable connector assembly organizing a plurality of electrical connectors side by side arranged.

2. Description of Related Art

In the recent years, Universal Serial Bus (USB) and audio jack become popular connection interface. The USB and audio jack are designed to provide input/output (I/O) ports of an electronic apparatus. With the trend toward miniaturization in electrical apparatus, a variety of compositive connector assemblies integrating a plurality of electrical connectors have been developed. U.S. Pat. No. 6,193,554 and U.S. Pat. No. 5,685,730 disclose a stacked USB connector assembly and an USB connector assembly arranged side by side adapted to be mounted on a mother board at an I/O port of an electronic apparatus for mating with complementary USB connectors of a peripheral equipment, i.e. a keyset, a mouse, a Personal Digital Assistant (PDA), or a Digital Camera. U.S. Pat. No. 6,234,834 further discloses a stack audio jack connector assembly adapted to be mounted on a mother board at an I/O port of an electronic apparatus for mating with complementary audio plug of a speak or a computer to provide an audio transmission therebetween.

The stacked connector assembly can save the space of the mother board compared to the electrical connectors arranged in a row, however, the stacked connector assembly can not be all mounted on an edge of the mother board when the I/O ports become more and more. To solve the problem, a cable connector assembly is required with a cable thereof electrically connected to the mother board of an electronic apparatus. The electrical connectors of the cable connector assembly, however, are assembled on a panel of the electronic apparatus adapted for mating with complementary connectors of other peripheral equipment.

Hence, a cable connector assembly organizing a plurality of electrical connectors arranged side by side with cables electrically connected on a mother board of an electronic apparatus is required to overcome the disadvantages of the related art.

SUMMARY OF THE INVENTION

An object of the present invention is to provide a cable connector assembly organizing a plurality of electrical connectors arranged with cables electrically connected on a mother board of an electronic apparatus.

In order to achieve the object set forth, a cable connector assembly in accordance with the present invention includes a housing, a pair of first electrical connectors, a pair of second electrical connectors, a shielding member, a pair of first cables and a second cable. The housing has an elongate base. The base has a mating face and a rear face opposite to the mating face. The base defines a pair of first cavities and a pair of second cavities arranged side by side and extending inwardly from the mating face. The first cables and the second cable respectively electrically connects with the first electrical connectors and the second electrical connectors and extend beyond the rear face for being electrically connected on a mother board of an electronic apparatus. The shielding member encloses a front portion of the housing. The cable connector assembly can be fastened on a panel of the electronic apparatus for providing input/output ports.

Other objects, advantages and novel features of the invention will become more apparent from the following detailed description when taken in conjunction with the accompanying drawings.

DETAILED DESCRIPTION OF THE INVENTION

Figure 1:
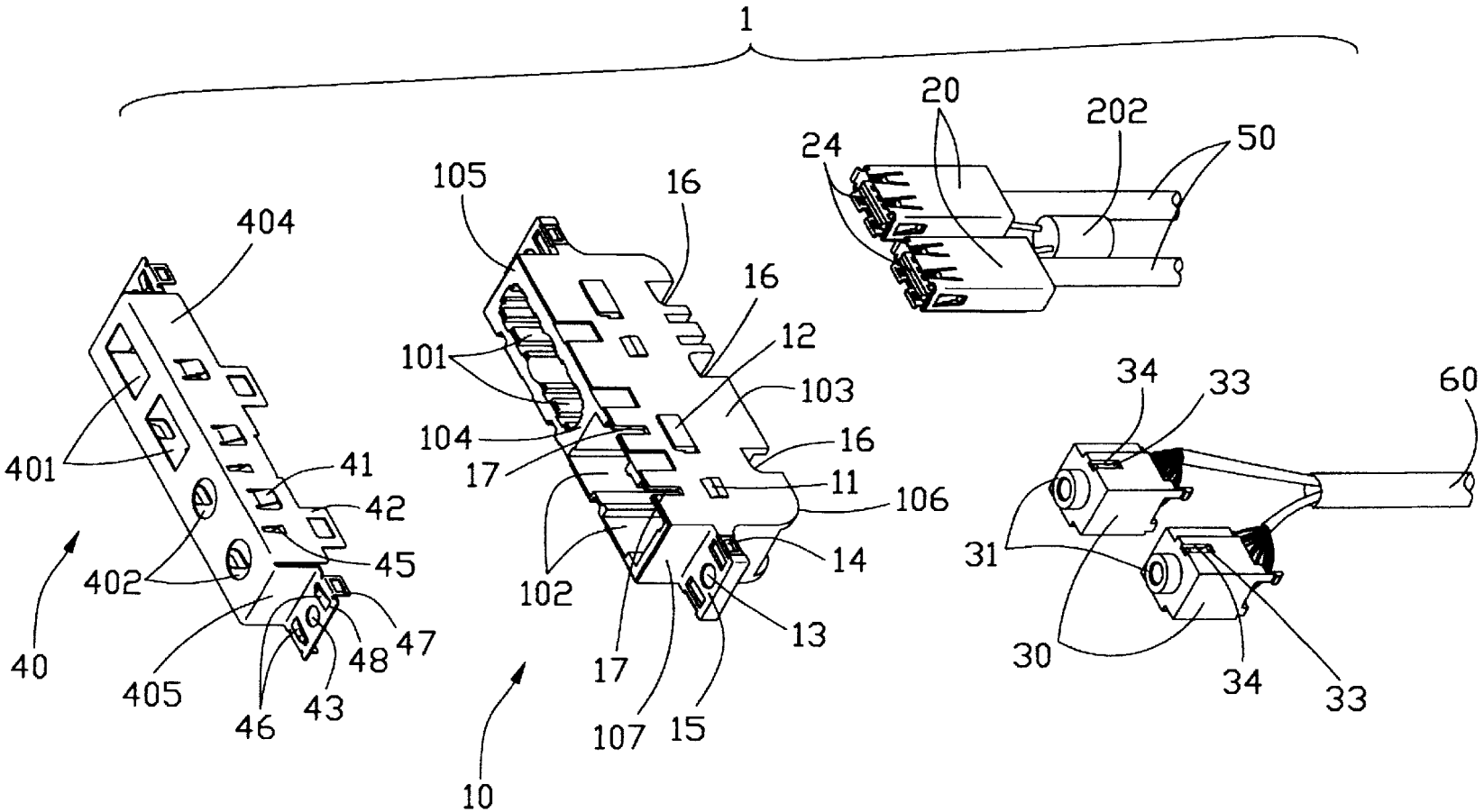
FIG. 1 is an exploded, perspective view of a cable connector assembly in accordance with the present invention.
Figure 2:
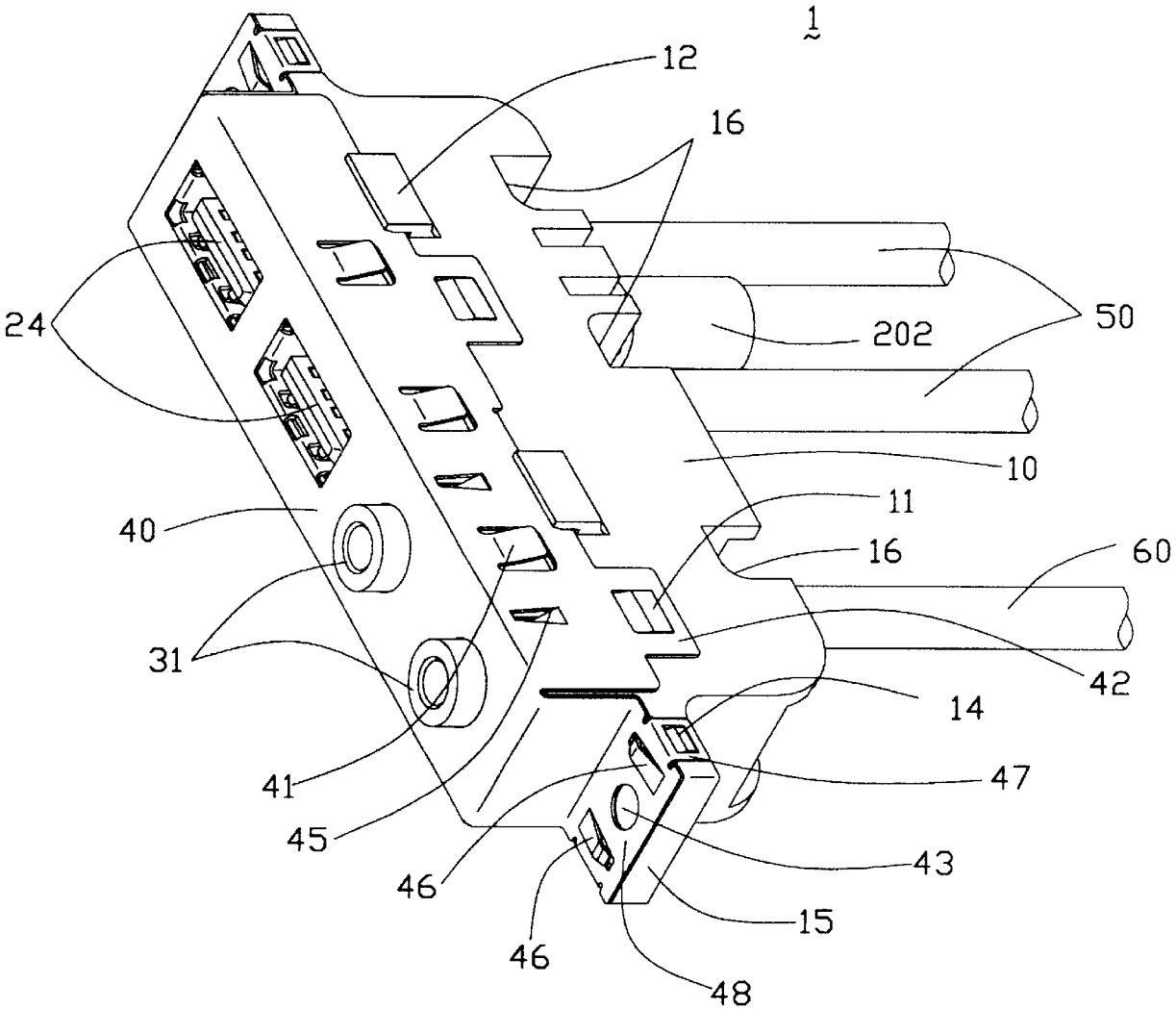
FIG. 2 is an assembled perspective view of the cable connector assembly of FIG. 1.

Referring to FIGS. 1–2, a cable connector assembly in accordance with the present invention, generally designated 1, is adapted for mating with a plurality of complementary connectors (not shown). The cable connector assembly 1 includes a dielectric housing 10, a pair of first electrical connectors 20, a pair of second electrical connectors 30, a shielding member 40, a pair of first cables 50 and a second cable 60. In the embodiment shown, the first electrical connectors 20 are typical standard Universal Serial Bus (USB) connectors and the second electrical connectors 30 are audio jack connectors. However, in alternative embodiments, the electrical connectors could be provided with any suitable types connectors.

The dielectric housing 10 generally molded of plastic or polymer material has an elongate base 103. The base 103 has a mating face 105, a rear face 106 opposite to the mating face 105 and a pair of lateral ends 107 connecting the mating face 105 and the rear face 106. The base 103 defines a pair of first cavities 101 communicating with each other for respectively receiving the first electrical connectors 20 therein, a pair of second cavities 102 communicating with each other for respectively receiving the second electrical connectors 30 therein, and an intermediate wall 104 partitioning the first cavities 101 and the second cavities 102. A pair of positioning slits 17 is defined on the upper side of the base 103 respectively communicating with the second cavities 102. A plurality of wedge protrusions 11 respectively projects upwardly and downwardly from an upper wall and a lower wall of the base 103. A plurality of holding portions 12 respectively projects upwardly and downwardly from the upper wall and the lower wall of the base 103 and aligning with the wedge protrusions 11. The holding portion 12 is L-shaped and defines a cutout (not labeled) at the front end thereof between the holding portion 12 and the base 103 for receiving edges of the shielding member 10 which will be described in detail later. A pair of side blocks 15 protrudes outwardly from the pair of lateral ends 107 of the base 103. Each side block 15 defines a retaining hole 13. A pair of wedge ribs 14 is disposed respectively at a top and a bottom of each side block 15.

A plurality of passageways 16 is defined in the base 103 from the rear face 107 recessing inwardly and respectively communicates with the first cavity 101 and the second cavity 102. The passageways 16 are provided for receiving the first cables 50 and the second cable 60.

Also referring to FIG. 1, the first electrical connectors 20 are a pair of typical USB connectors arranged side by side. A structure of the USB connector is well known to persons skilled in the art, detailed description thereof is omitted here. The pair of first cables 50 is respectively connected with the pair of first electrical connectors 20. Each first electrical connector 20 has a mating port 24 at the front portion thereof. It should be noted that a capacitor 202 is disposed between the rear portions of the fair of first electrical connectors 20 for providing a filterable function.

The second electrical connectors 30 are a pair of audio jack connectors arranged side by side. The second electrical connector 30 has a same structure as an ordinary audio jack connector and the detailed description thereof is omitted here. However, it should be noted that each second electrical connector 30 defines a cutout 34 adjacent to a mating port 31 thereof. The second electrical connector 30 further comprises a grounding terminal 33 extending into the cutout 34 and exposed therein. The second cable 60 has a pair of segments at the front end thereof for respectively connected with the second electrical connectors 30.

Figure 4:
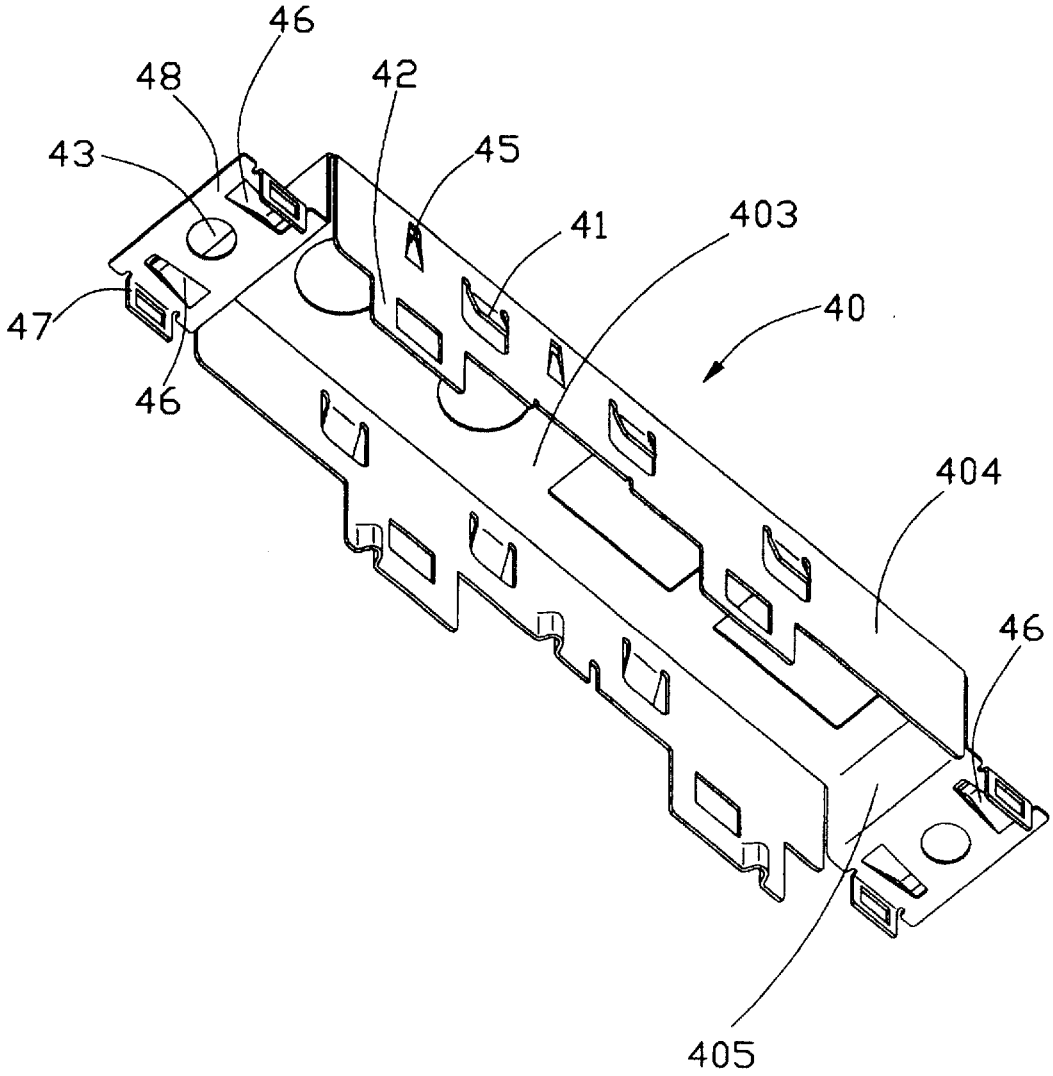
FIG. 4 is a perspective view of a shielding member of the cable connector assembly of FIG. 1.

Referring to FIG. 1, FIG. 4 in conjunction with FIG. 2, the shielding member 40 is generally stamped from a piece of metal or other conductive materials. The shielding member 40 is in an elongate frame shape for substantially shielding the front portion of the housing 10. The shielding member 40 comprises a front wall 403, a pair of sidewalls 404 respectively extending rearward from opposite top and lower sides of the front wall 403, and a pair of lateral walls 405 connecting with opposite lateral sides of the pair of sidewalls 404. The front wall 403 defines a pair of first holes 401 aligning with the first cavities 101 and a pair of second holes 402 aligning with the second cavities 102 allowing the mating port 31 of each second electrical connector 30 extending therethrough. The first hole 401 is rectangular and the second hole 402 is round. Each sidewall 404 is stamped to form a plurality of engaging taps 41 protruding outwardly and a pair of contact taps 45 protruding inwardly therefrom. The engaging taps 41 are devised for electrically engaging with a panel of a computer when the cable connector assembly 1 is assembled in the computer. The contact taps 45 extend through the positioning slits 17 of the housing 10 and electrically mates with the grounding terminals 33 retained in the cutouts 34 therein. A plurality of retaining flakes 42 extends rearward from each sidewall 404 which defines a cutout (not labeled) for receiving the wedge protrusions 11 of the base 101.

A pair of side plates 48 each bends from a rear side of the lateral walls 405. Each side plate 48 defines a hole 43 corresponding to the retaining hole 13 of the side block 15 of the housing 10 for a corresponding screw extending therethrough. A plurality of engaging taps 46 is stamped and protrudes forwardly therefrom for electrically engaging with the panel of the computer which is similar to the engaging taps 41 formed on the sidewalls 404. A pair of retaining flakes 47 respectively bends from the top and lower sides of each side plate 48 which defines a cutout (not labeled) for receiving a corresponding wedge rib 14 of the side block 15 for providing a retention therebetween.

In assembly, as shown in FIGS. 1–2, the first electrical connectors 20 and the second electrical connectors 30 respectively connect with the first cables 50 and the second cable 60 with the terminals (not labeled) thereof respectively soldered to the corresponding conductors of the first cables 50 and the second cables 60 which is well known for persons skilled in the art and the detailed description is omitted here. The first electrical connectors 20 and the second electrical connectors 30 are respectively inserted in the first cavities 101 and the second cavities 102 from a mating face 105 of the base 101 with the mating ports 24 and the mating ports 31 thereof exposed away the mating face 105. Correspondingly, the first cables 50 and the second cable 60 extend through the passageway 16 and beyond the rear face 106 of base 101.

Subsequently, the shielding member 40 is assembled to the housing 10 with the front wall 403 thereof abutting against the mating face 105 of the base 101. The sidewalls 404 and the later walls 405 of the shielding member 40 enclose the front portion of the base 101 with the rear edges retained in the cutouts of the holding portion 12. Each side plate 48 of the shielding member 40 engages with the side block 15 of the housing 10. The retaining flakes 42, 47 are respectively engaged with the wedge protrusions 11 and the wedge ribs 14 of the base 103 for providing a reliable retention therebetween. The first holes 401 and the second holes 402 respectively corresponds to the first cavities 101 and the second cavities 102 for allowing the mating ports 24 of the first electrical connectors 20 and the mating ports 31 of the second electrical connectors 30 extending therethrough. The cable connector assembly 1 is thus accomplished.

The first cables 50 and the second cables 60 are designed for connecting with corresponding circuit traces on a mother board of a computer. A corresponding screw (not shown) extends ordinally through the retaining hole 13 of the side block 15 of the housing 10 and the hole 43 of the side plate 48 of the shielding member 40 for fastening the cable connector assembly 1 to a panel of the computer. The cable connector assembly 1 is thus electrically connected with the mother board and adapted for mating with complementary connectors for providing Input/Output transmission.

Figure 3:
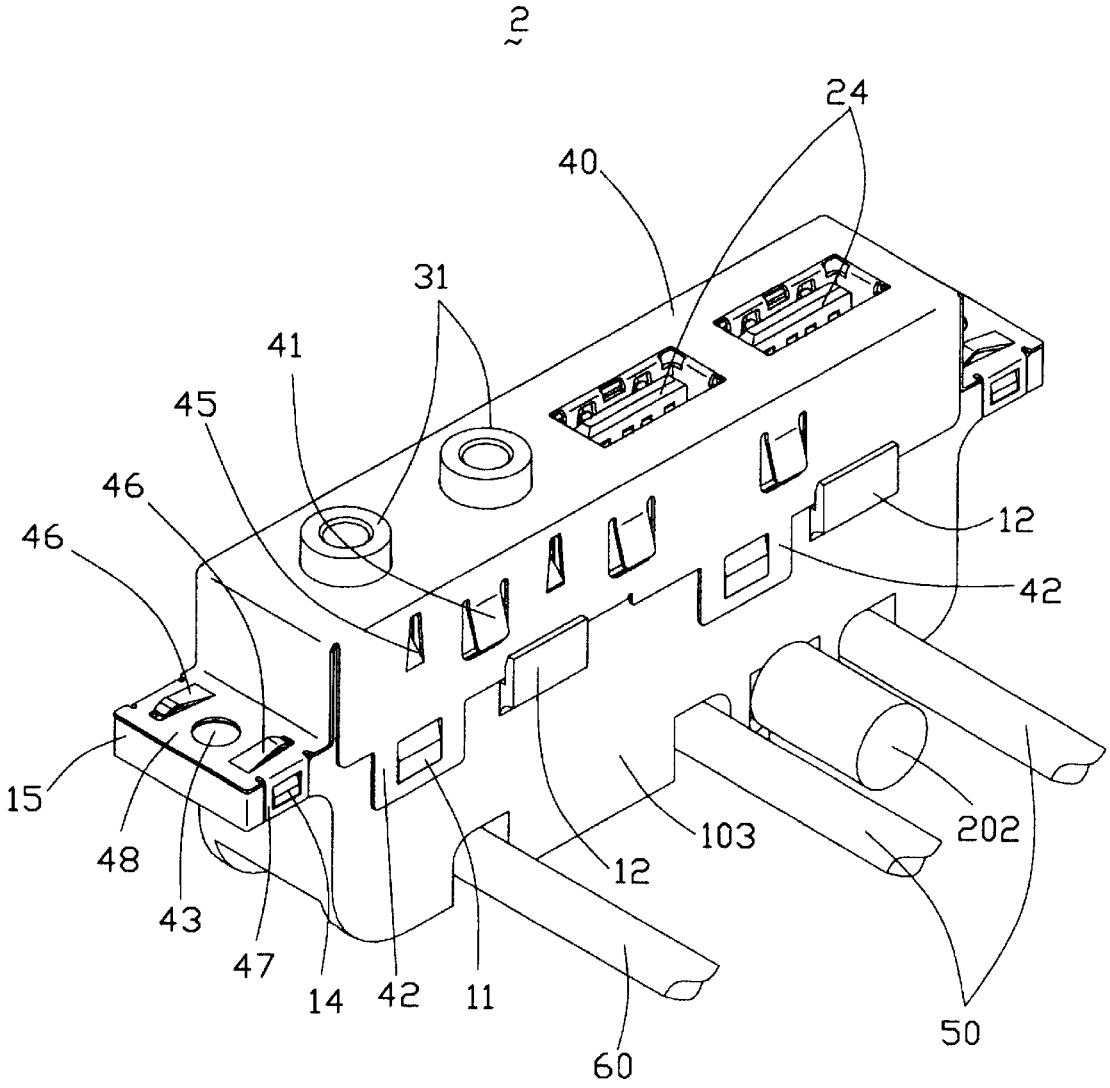
FIG. 3 is an assembled perspective view of the cable connector in a second embodiment.

It should be noted that the first cables 50 and the second cable 60 extend directly beyond the rear face 103 of the housing 10. However, to meet the arrangement of the cables in a computer, the first cables 50 and the second cable 60 can be arranged in alternative means. For example, FIG. 3 shows a cable connector assembly 2 in a second embodiment. The first cables 50 and the second cable 60 of the cable connector assembly 2 first bend and then are received in the passageways 16 defined from the rear face 103 and later extends away the rear face 103 for electrically connected with a mother board of a computer.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly comprising:

a housing having an elongate base and defining a pair of first and a pair of second cavities arranged in a side by side manner, an intermediate wall partitioning the first and the second cavities, a pair of positioning slits defined on an upper side of the base respectively in communicating with the pair of second cavities, a pair of side blocks protruding outwardly from a pair of lateral ends of the base, wherein each of said side blocks defines a retaining hole, a pair of wedge ribs being disposed respectively at a top and a bottom of each of said blocks, a plurality of holding portions respectively projecting upwardly and downwardly from a top and bottom face of the base, each of the holding portions being L-shaped and defining a cutout at a front end thereof between the holding portion and a top face of the base for receiving edges of a shielding member;

a pair of typical Universal Serial Bus connectors and a pair of typical audio jack connectors respectively received in the first and second pairs of the cavities, each of the audio jack connectors defining a cutout adjacent to a mating portion and a grounding terminal extending into the cutout;

a shielding member enclosing a front portion of the housing, the shielding member comprising a front wall defining a pair of rectangular holes aligning with the pair of the first cavities and a pair of round holes aligning with the pair of second cavities, a pair of side walls each stamped to form a plurality of engaging taps protruding outwardly for electrically engaging with a panel of a computer and a pair of contact taps protruding inwardly extending through the positioning slits of the housing and electrically mating with the grounding terminal retained in the cutout, a pair of side plates each bent form a rear side of lateral walls and defining a hole corresponding to the retaining hole of the side block of the housing for a corresponding screw extending therethrough, a plurality of engaging taps stamped and protruding forwardly therefrom for electrically engaging with the panel of the computer, a pair of retaining flakes respectively bent from top and lower sides of each side plate defining a cutout for receiving a corresponding wedge rib of the side block for providing a retention therebetween.

2. The cable connector assembly as claimed in claim 1, wherein the housing defines a plurality of passageways extending inwardly from the rear face of the base receiving the first cable and the second cable therein.

* * * * *